US007607276B2

(12) United States Patent
Gordin et al.

(10) Patent No.: US 7,607,276 B2
(45) Date of Patent: Oct. 27, 2009

(54) POLE COVER OR SLEEVE

(75) Inventors: Myron K. Gordin, Oskaloosa, IA (US); James L. Drost, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 0 days.

(21) Appl. No.: 10/620,959

(22) Filed: Jul. 16, 2003

(65) Prior Publication Data

US 2004/0074199 A1 Apr. 22, 2004

Related U.S. Application Data

(60) Provisional application No. 60/396,479, filed on Jul. 17, 2002.

(51) Int. Cl.
*E04B 1/00* (2006.01)

(52) U.S. Cl. ..... 52/834; 52/170; 52/746.1; 52/848

(58) Field of Classification Search ..... 52/726.4, 52/720.1, 632, 741.14, 726.1, 736.1, 736.2, 52/723.1, 736.3, 736.4, 170, 746.1, 848, 52/834; 428/36.91
See application file for complete search history.

(56) References Cited

U.S. PATENT DOCUMENTS 35,322 A * 5/1862 Owen et al. ..... 362/168
1,521,285 A * 12/1924 Erickson Axel B ..... 52/170
1,668,020 A * 5/1928 Marquardt ..... 52/736.4
1,784,770 A * 12/1930 Wiley ..... 52/170
3,034,209 A * 5/1962 Edoardo et al. ..... 29/432
3,270,480 A * 9/1966 Beecker ..... 52/726.4
3,564,804 A * 2/1971 Archer et al ..... 52/745.17
3,968,561 A * 7/1976 Oakes et al. ..... 29/460
4,019,301 A * 4/1977 Fox ..... 52/721.4
4,092,079 A * 5/1978 Swanson ..... 403/306
4,216,634 A * 8/1980 Binder ..... 52/309.9
4,295,317 A * 10/1981 VanTielen ..... 52/637
4,543,764 A * 10/1985 Kozikowski ..... 52/746.1
4,598,512 A * 7/1986 Chapman ..... 52/165
4,769,967 A * 9/1988 Bourrieres ..... 52/736.3
4,779,389 A 10/1988 Landers (Continued)

FOREIGN PATENT DOCUMENTS

EP 0 303 365 2/1989

(Continued)

OTHER PUBLICATIONS

Hawley's Condensed Chemical Dictionary, Lewis, Sr. 1997, John Wiley & Sons, Inc. 13, 908.*

*Primary Examiner*—Basil Katcheves
(74) *Attorney, Agent, or Firm*—McKee, Voorhees & Sease, P.L.C.

(57) ABSTRACT

An apparatus, method and system for covering and protecting substantially tall poles. The apparatus includes a covering layer positionable over at least a portion of the exterior of a pole. The covering layer is non-corrosive and preferably impact and tear resistant. In one aspect of the invention, the covering layer is a sheet of material dimensioned to wrap around a corresponding part of the pole. A bracket can be used to secure the opposite adjacent edges of the wrap. Hardware can be used to secure the wrap from longitudinal movement along the pole. The wrap can be colored, textured, or patterned.

46 Claims, 7 Drawing Sheets

U.S. PATENT DOCUMENTS 5,117,607 A * 6/1992 Bourdon ..... 52/732.3
5,534,590 A * 7/1996 Horiie ..... 525/71
5,600,537 A 2/1997 Gordin et al.
5,858,493 A * 1/1999 Sandt ..... 428/36.91
5,869,159 A * 2/1999 Padilla ..... 428/40.1
6,167,673 B1 1/2001 Fournier
6,286,266 B1 * 9/2001 Popowych et al. ..... 52/40
6,340,790 B1 * 1/2002 Gordin et al. ..... 174/45 R

FOREIGN PATENT DOCUMENTS

WO WO 93/03241 2/1993

* cited by examiner

POLE COVER OR SLEEVE

CROSS-REFERENCE TO RELATED APPLICATIONS

This application is a conversion of and claims priority to prior U.S. Provisional Patent Application 60/396,479 filed Jul. 17, 2002, herein incorporated by reference in its entirety.

BACKGROUND OF THE INVENTION

A. Field Of The Invention

The present invention relates to a covering or sleeve over the exterior of a pole, and, in particular, to a covering or sleeve which can either be retrofitted to existing erected poles or installed during manufacturing of the pole or portions thereof.

B. Problems in the Art

To elevate structures, there must either be existing superstructure from which to suspend the structure, or the same must be created. In the latter case, many times the most cost-effective way to do so is with a pole. A variety of pole types exist including, but not limited to, wood, tubular metal, and even concrete. Poles can range from relatively short (a few feet tall) to relatively tall (over 100 feet tall).

One popular type of pole is hollow metal. It can be relatively thin-walled for economy of material, yet is relatively strong. Steel is a common choice. It can be galvanized to resist corrosion.

However, even galvanized steel can lose resistance to corrosion over time, especially when exposed to outdoor environments. A similar problem exists for other metals. Even wood and concrete, to some extent, may deteriorate over time.

A conventional method to try to protect materials is to paint their exterior. However, paint may not be very effective. It is subject to deterioration. It is also subject to scratches and chips. Sometimes paint does not adequately adhere to the surface. Also, the degree of protection is many times directly related to how well it is applied. Still further, it has been found to be difficult or costly to try to paint galvanized metal poles to impart some protection of the same. This is especially true once the pole is erected.

Therefore, a need has been identified in the art for protection of poles against the elements.

Still further, galvanized metal poles tend to have essentially one relatively consistent color. It is sometimes desirable to have different colors. For example, it is sometimes desirable to match the color of poles to their surroundings (e.g. green for grass or trees). Another example would be to match pole colors to team colors or school colors. Other examples and reasons for coloring a pole differently than the ordinary color of the material from which it is made exist.

The need has been identified to add the option of different colors for poles, other than the natural color of their structural material. This is true both for retrofitting existing erected poles or during manufacturing of new poles.

There are other instances where it is desirable to alter the surface or texture of a pole material. For example, metal poles tend to be very smooth. It might be desirable to change the surface to have a certain textured surface or maybe even have some sort of pattern which differs from that of the original structural material. Another example would be to attempt to provide a smoother surface than those of wood or concrete poles to deter splinters or scrapes.

Therefore, there is a need and an advantage believed to be existent relative to the state of the art for an apparatus and method which can alter or improve the aesthetic appearance of poles elevating structures to substantial heights. Further needs or advantages include the ability to provide protection to poles or otherwise protect the exterior of the natural material of poles, even to material which has been treated or manufactured to provide additional protection to the material (e.g. galvanization of tubular steel poles).

BRIEF SUMMARY OF THE INVENTION

The present invention relates to the concept of adding a cover or sleeve to poles, especially substantially tall poles. The cover can be installable in sections to cover some or all of the pole.

In accordance with the invention, an added-on covering can make a pole less susceptible to damage than if painted (for example, paint can be susceptible to scratching and chipping), including when loading or unloading poles, or setting poles into vertical positions. It can also be used to alter to customize the appearance or external surface of the pole.

The cover or sleeve can be retrofitted or included in the original assembly of the pole or its sections. Optionally, it can comprise a sheet of material that can be shaped to conform to the exterior circumference of a section of the pole. Still further there optionally can be hardware or structure that is adapted to lock or retain the sheet into position when wrapped around the pole. Still further, there can be structure associated with the sheet and/or the pole to hold the sheet, wrapped around the pole like a sleeve or cover, against movement relative to the longitudinal axis of the pole.

The cover sheet can be used to for such things as to protect the pole, alter the surface of the pole, or alter the color of the pole.

DETAILED DESCRIPTION OF AN EXEMPLARY EMBODIMENT

A. Example of Existing Structure to Which Invention Can be Applied

Figure 1:
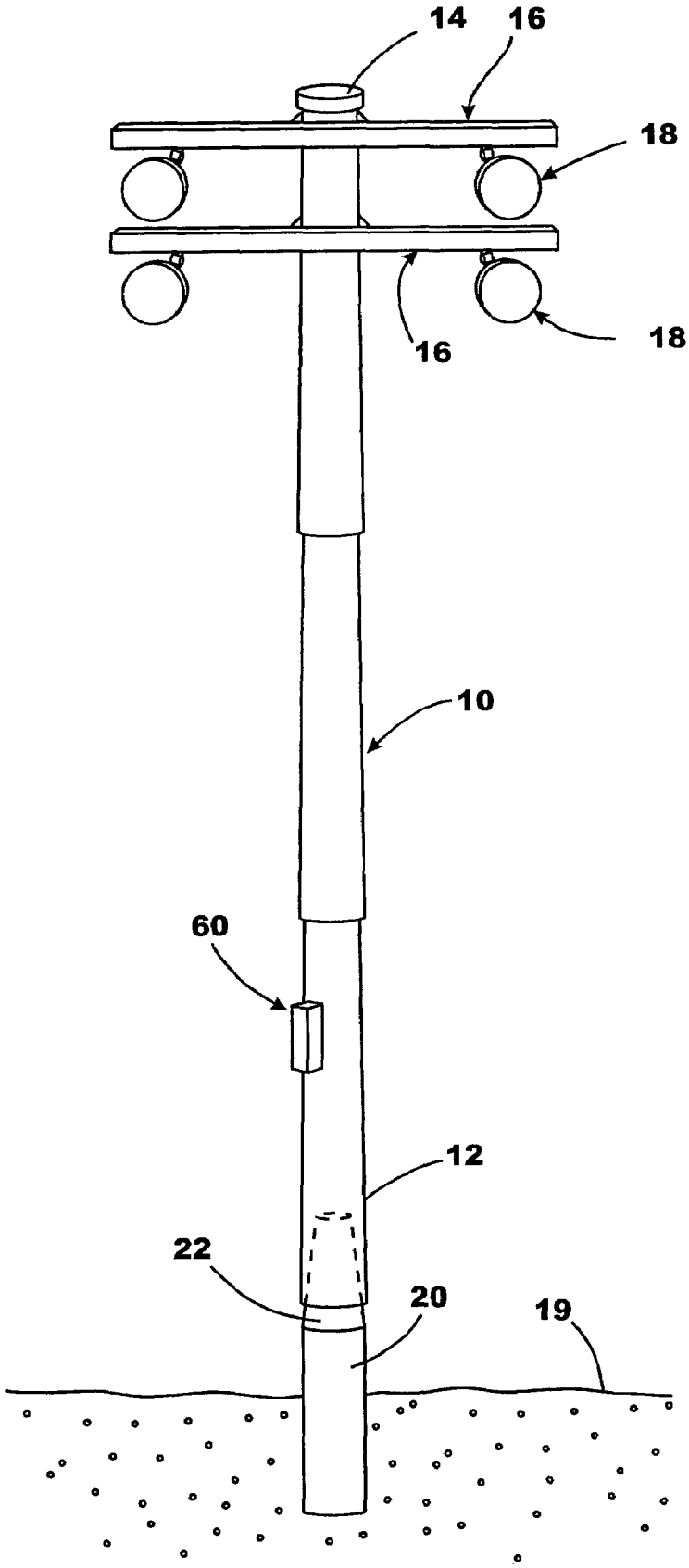
FIG. 1 is a not-to-scale vertical elevation view of light pole to which is installed a pole cover or sleeve according to one exemplary embodiment of the present invention.

FIG. 1 illustrates generally a pole 10 of hollow tubular galvanized steel having a lower end 12 and an upper end 14. This pole is anywhere from around 30 to 100 or more feet in length. Cross arms 16 are welded or otherwise secured to the top 14 of pole 10. Light fixtures 18 are adjustably secured to cross arm 16. This general type of structure is well known in the art.

In this particular pole, galvanized steel tubular pole 10 is tapered from top to bottom with slightly increasing diameter there along. Pole 10 can be made of one piece or can be in sections. FIG. 1 illustrates a particular type of pole and mounting system for the same of the type disclosed in U.S. Pat. No. 5,600,537, which is co-owned by the owner of the present application, and which is incorporated by reference herein. A base 20, installed in a plumbed position in ground 19, includes a stub 22 having a taper that substantially matches the taper of the bottom 12 of pole 10. Pole 10 is seated upon stub 22 to support it in a plumbed vertical position. Many times a ballast box 60 or other electrical circuitry or components could be mounted on pole 10 or base 22 or cross arms 16. In FIG. 1, ballast box 60 is mounted along pole 10.

Therefore, FIG. 1 shows a hollow steel tubular pole 10, such as are in use to elevate structures to substantial heights, and to which the present exemplary embodiment of the invention can be retro-fitted.

B. General Structure of Exemplary Embodiment According to Invention

Figure 2:
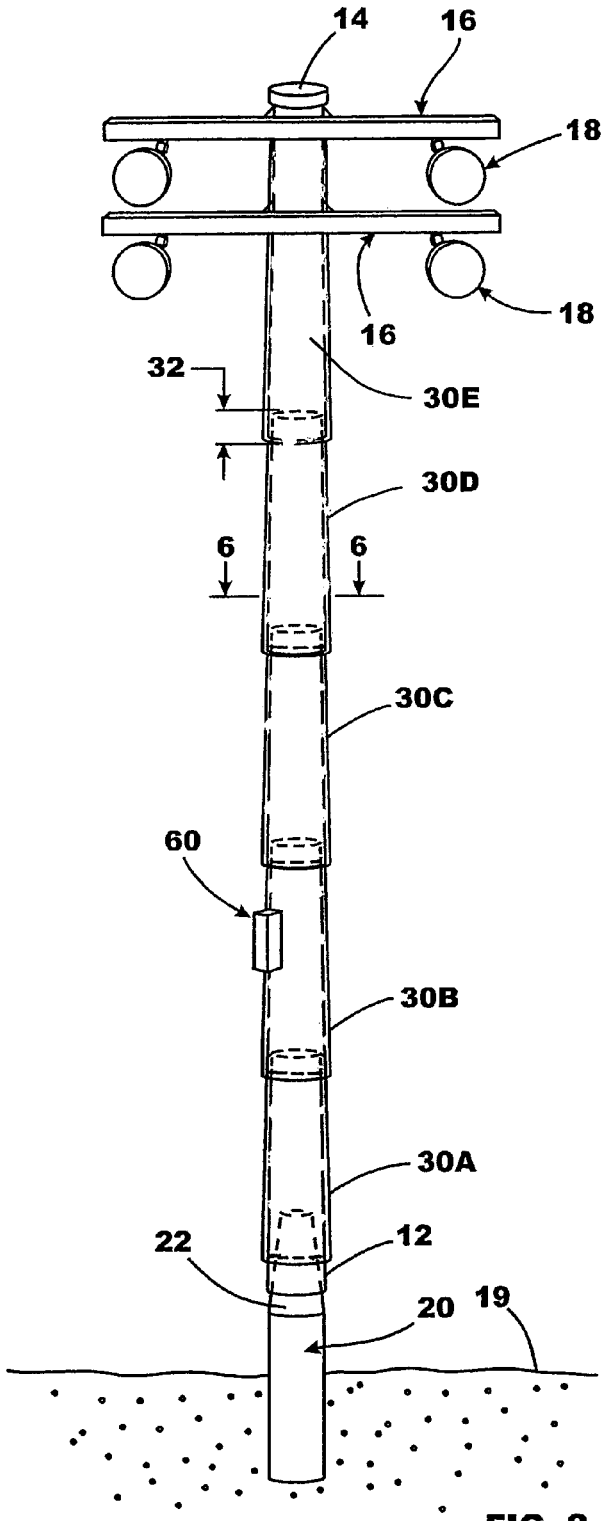
FIG. 2 is similar to FIG. 1 providing another example of a pole and a pole cover or sleeve according to the present invention showing in ghost lines additional details of individual sections of the pole cover or sleeve.

FIG. 2 illustrates an embodiment of the invention installed on a pole 10 of the type of FIG. 1. A set of covers or sleeves are installed along the length (approximately 45 feet total length) of pole 10 from substantially its bottom 12 up to near the bottom-most cross arm 16 (see reference numbers 30A-E). Each sleeve 30A-E is substantially the same height (e.g. approx. 8 feet) and is made of a sheet of vinyl (0.040' or 1 mm thick) that has been wrapped around pole 10. One example is KYDEX™ sheet, 0.040 inch thick, cut to match the taper of the pole, and with formed sides (see view A-A of FIG. 4B, which is intended to show the shape of both sides of the sheet). Adjacent portions of each sleeve section 30A-E can be overlapped (e.g. 3"); preferable the lower edge of each succeeding higher section 30 overlaps the upper edge of each preceding section 30.

No sleeve section 30 would cover the slip-fit joint between adjacent poles sections. Those joints would remain metal to metal. But, succeeding bottoms of sleeve sections 30 would extend over tops of preceding sleeve sections 30 (and over the slip-fit pull joint) to shield the tops of the preceding sleeve sections 30.

As can be appreciated, covering substantially all of pole 10 tends to protect the surface of pole 10. Preferably, some method of sealing the top-most edge of each section 30, relative to the pole, can be used to further deter any moisture or water or debris from getting between the cover sections 30 and the pole. This could be with some sort of caulking or other sealant (e.g. silicone), or some sort of an elastic or malleable ring or cap.

C. Specific Structure of Exemplary Embodiment

Figure 3:
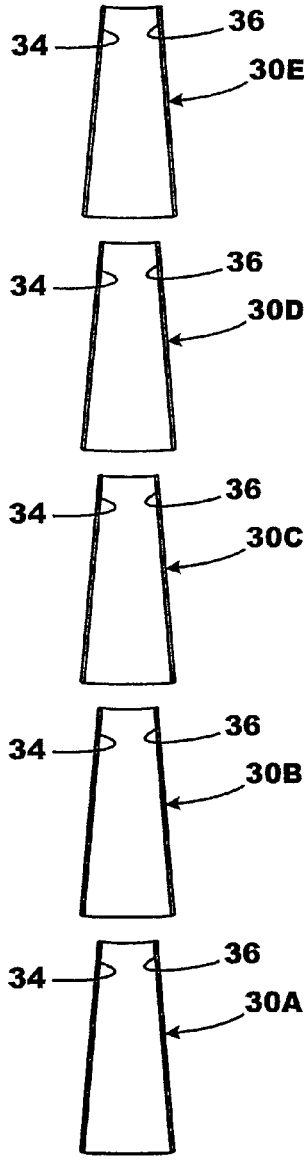
FIG. 3 is an illustration of each of the individual sections 30A-30E of FIG. 2 removed from a pole and illustrated in flat projection, including opposite edges 34 and 36.

FIG. 3 shows sleeve sections 30A-E in isolation and spread somewhat flat. As illustrated in FIG. 3, for a tapered pole 10, each section 30 could be manufactured from a sheet of material in a trapezoidal shape such that when wrapped around pole 10, opposite vertical edges would essentially or generally be aligned parallel to the longitudinal axis of the pole. Each section 30 could be made of a slightly different outline shape for different sections of the pole to accommodate variations in the diameter of the pole from top to bottom (if a tapered pole). The dimension of each section 30A-E could be predesigned for certain sized poles. The number of sections 30 would, of course, vary depending on the height of the pole, the diameter of the pole gradually reduces from bottom 12 to top 14. As illustrated in FIGS. 3-7, opposite edges 34 and 36 of each section 30A-E could be formed in a fashion to cooperate with an aluminum extrusion 40 which can be utilized to connect those edges by capturing or hooking those edges in parts of that extrusion.

Figure 4A:
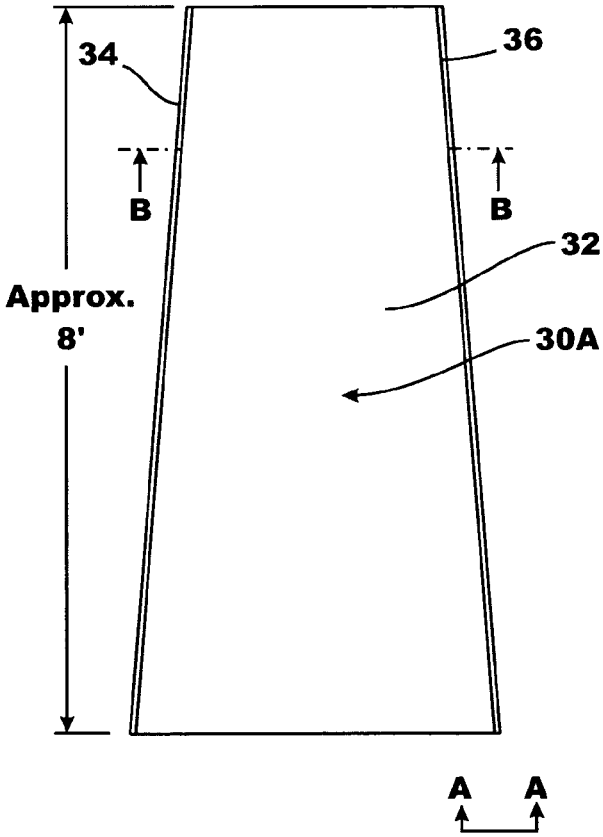
FIG. 4A is an enlarged flat projection illustration of section 30A of FIGS. 2 and 3.
Figure 4C:
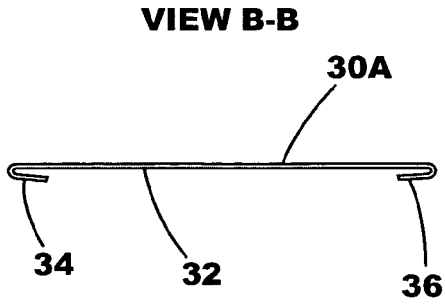
FIG. 4C is a sectional view taken along line B-B of FIG. 4A.
Figure 4B:
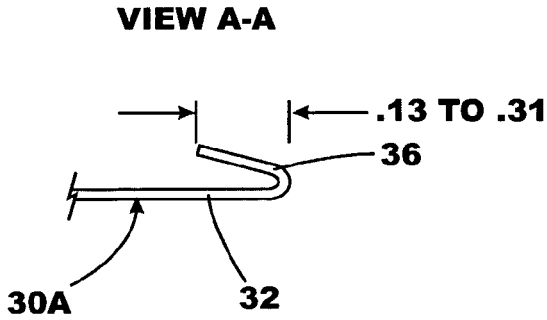
FIG. 4B is an enlarged edge view along line A-A of FIG. 4A.

FIGS. 4A-C shows the nature of edges 34 and 36 more precisely. Each edge is rolled under or rolled in the sense that it curves back towards the middle of the sheet 30 (see especially FIGS. 4B and 4C). In cross-section or end view, each edge 34 and 36 has somewhat "U" shape (e.g. aluminum 6063-T0 and 6063-T4; remove all burrs; break all edges and sharp corners 0.01 min.). The taper of the pole section can vary, so the diameter along the section varies with the taper.

Figure 5A:
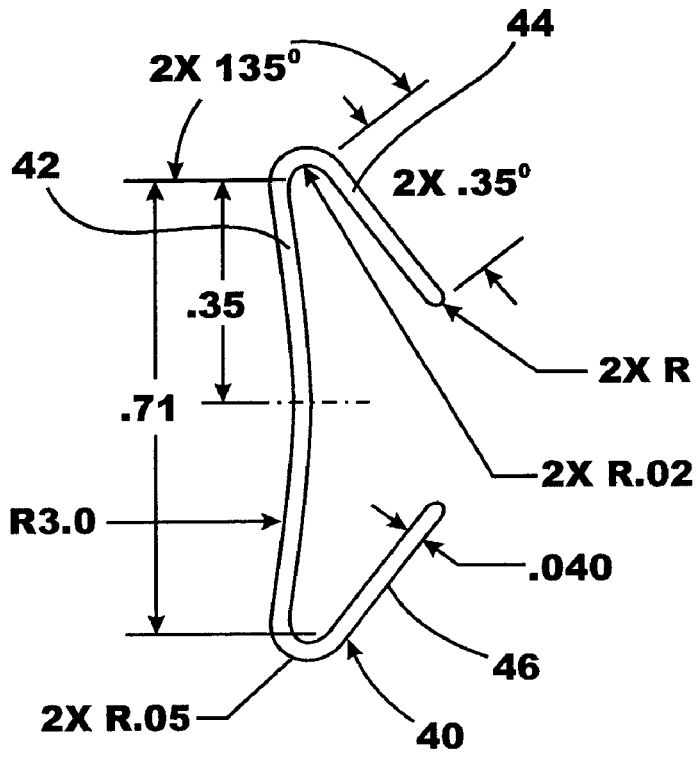
FIG. 5A is an enlarged end edge view of a retainer clip that can cinch opposite edges 34 and 36 of a section 30A-E around a pole according to another exemplary embodiment of the present invention.
Figure 5B:
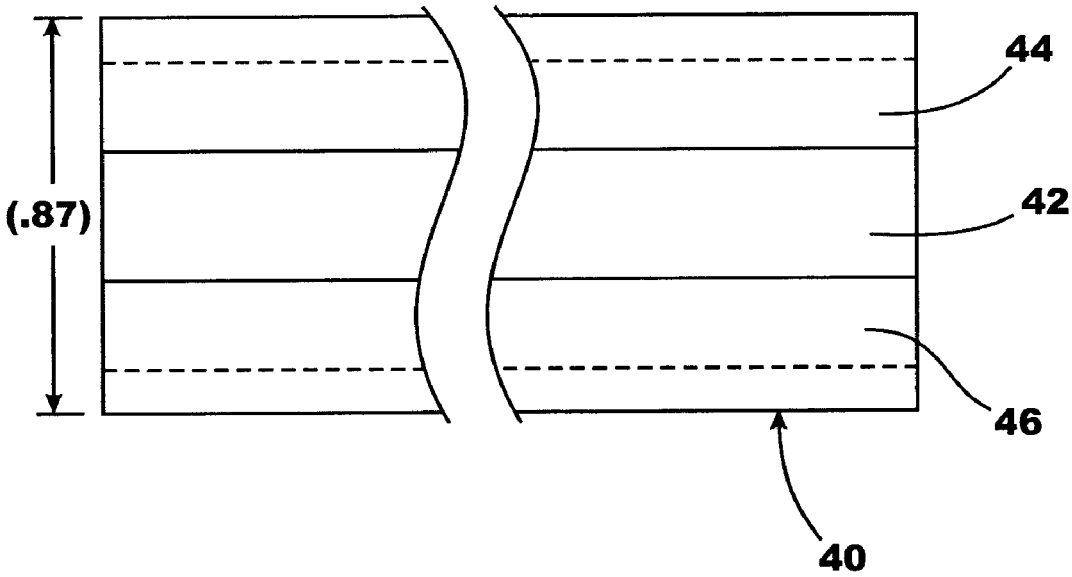
FIG. 5B is a longitudinal plan view of the clip of FIG. 5A.

FIGS. 5A and B show in more detail aluminum extrusion 40. Extrusion 40 would be approximately the same length (8 feet approx.) of the up and down dimension of a sheet section 30 and, shown in FIG. 5A, somewhat of a "C" shape in cross section or by end view.

Figure 6A:
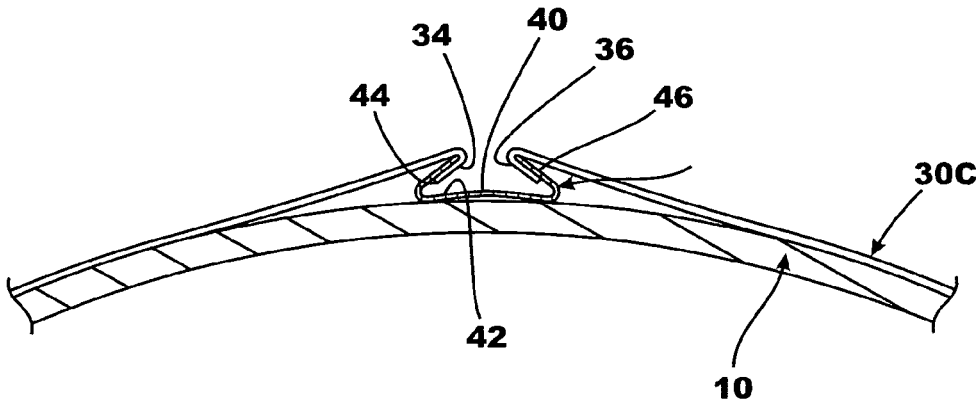
FIG. 6A is an illustration of how the clip of FIGS. 5A and 5B can be used to mount a section 30C around a pole.
Figure 6B:
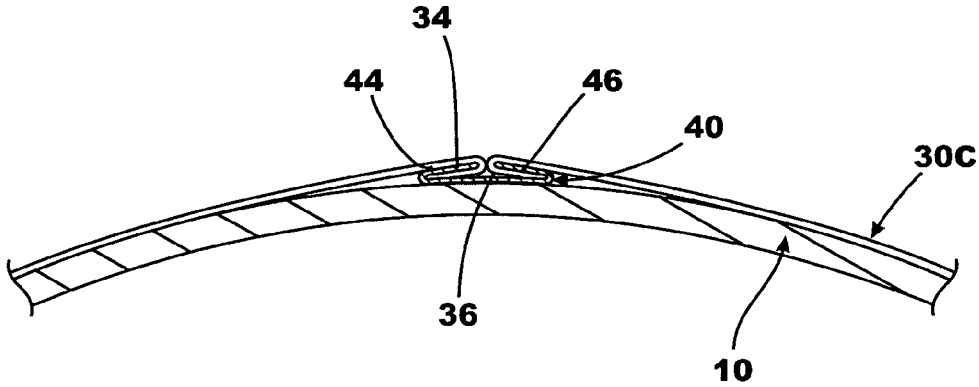
FIG. 6B is similar to FIG. 6A but shows how opposite sides 44 and 46 of clip 40 can be bent towards the pole and the sides of section 30C brought together to cinch it more closely to the pole.

FIGS. 6A and B illustrate how extrusion 40 secures a sheet or sleeving section 30 to pole 10. First, a sleeving section 30 is wrapped around the desired part of pole 10. Extrusion 40 is placed with opposite walls 44 and 46 pointing away from pole 10 but along longitudinal axis of pole 10 on its exterior surface. In normal form, arms 44 and 46 of extrusion 40 are at the angle indicated in FIG. 5A relative to the base portion 42. This provides an opening along the longitudinal axis between walls 44 and 46 into which the U-shaped edges 34 and 36 of a sheet section 30 can be inserted (see FIG. 6A). Second, extrusion 40 is pushed up through adjacent formed edges 34 and 36 of sleeve 30 (see FIG. 6A) until the top and bottom of extrusion 40 is generally aligned with the top and bottom of sleeve 30 respectively. This assumes that the sleeving section 30 selected relatively closely matches the perimeter circumference of pole section 10. Third, as indicated in FIG. 6B, the "soft" aluminum extrusion is "rolled" down (e.g. with a heavy rolling pin) to complete what will be called a seam. This pulls sleeve section 30 a bit tighter to pole 10 and flattens down the extrusion and ends 34 and 36 of the sleeve closer against the pole all along its 8 foot length.

Figure 7:
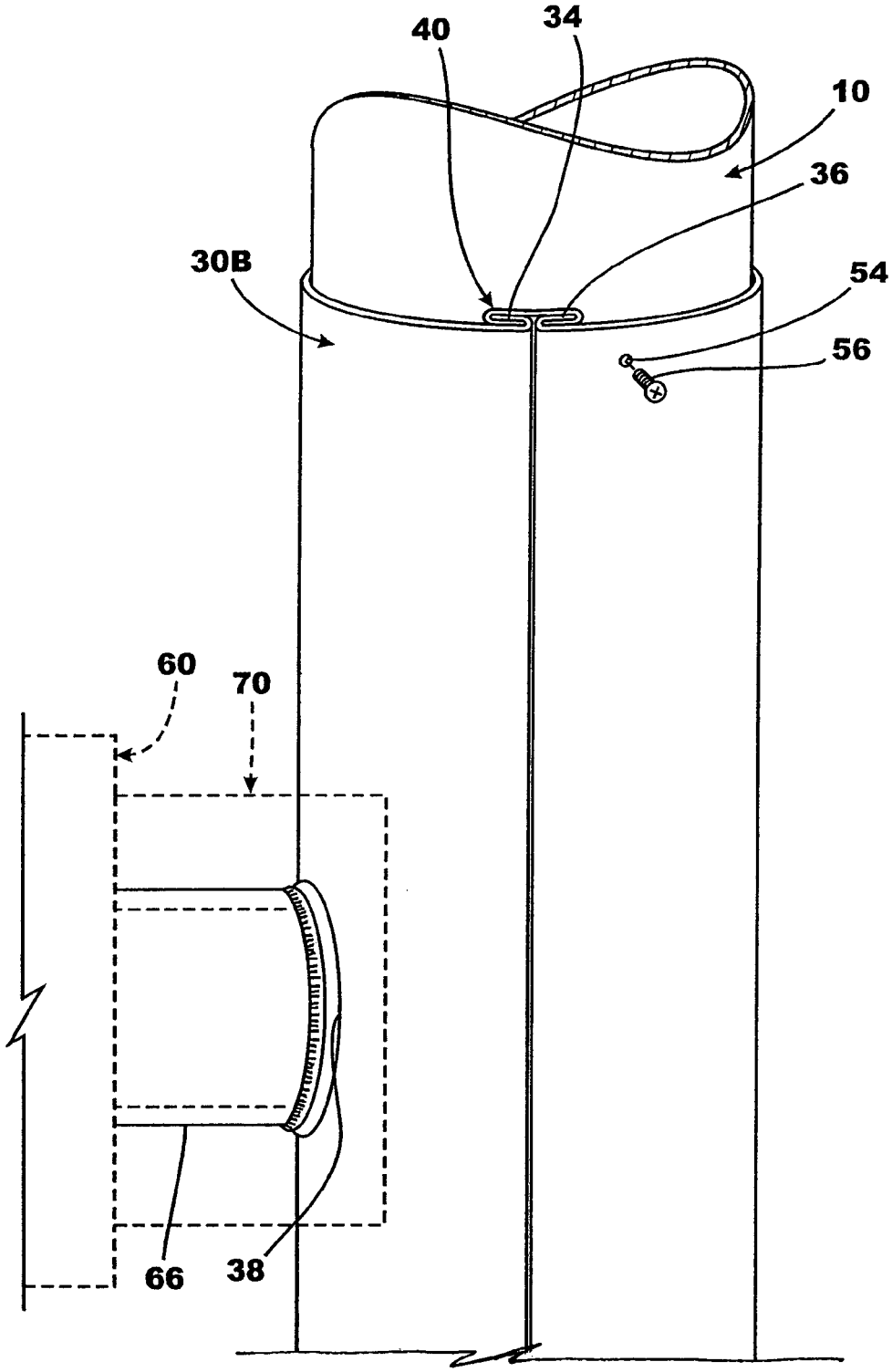
FIG. 7 is a partial sectional perspective view of a section 30B installed and cinched around a pole with a clip 40 and including additional aspects such as a retaining screw 56 or a cutout in member 30B to accommodate a lateral member from the pole.

As further indicated by FIG. 7, when the seam is created, sleeve section 30 becomes a conforming cover or sleeve around that part of pole 10.

D. Options and Alternatives

It will be appreciated that invention can take many forms and embodiments. Variations obvious to those skilled in the art are included within the invention.

As can be appreciated, different types of materials can be utilized for a cover or sheet. Dimensions can vary. One sheet could be used for an entire length of the pole. Alternatively, as indicated above, much smaller sections could be utilized.

FIGS. 6 and 7 illustrates that hole 54 can be pre-formed or created (e.g. drilled, punched) at the top of sleeve section 30. A metal screw 56 could be used to bite into pole 10 through hole 54 and pin sleeve section 30 at the top to pole 10. By pinning each sleeve section 30 near its top, it would prevent both rotation around pole 10 and movement longitudinally of sleeve section 30 along pole 10. But still further, as mentioned before, sleeve sections 30 can overlap each other. By pinning each section at the top, it allows the bottom of each section to expand or contract over temperature extremes freely, but the overlapping still covers areas between sleeve sections 30.

Alternatively a nut (not shown) could be welded or otherwise secured around a drilled hole in the side of pole 10. When sections 30 are wrapped around the pole, a hole performed or created in sheet section 30 can be aligned with the nut and hole combination on pole 10, and a screw or bolt inserted through the hole in sheet 30 and then turned into the nut to hold that section 30 against longitudinal movement relative to pole 10.

FIG. 7 also shows that portions of sleeve section 30 could be pre-cut (before installation) or post-cut (during or after installation) around places needed for hubs, hand holes, mounting studs, or the like. In FIG. 7, hole 38 could be pre-formed in sleeve section 30B to accommodate a hub 66 for connection to ballast box 60. When wrapping sleeve section 30B, opening 38 would be aligned with hub 66 prior to installation of ballast box 60, and opening 38 would fit around that hub. See also FIG. 8A.

Figures 8A, 8B:
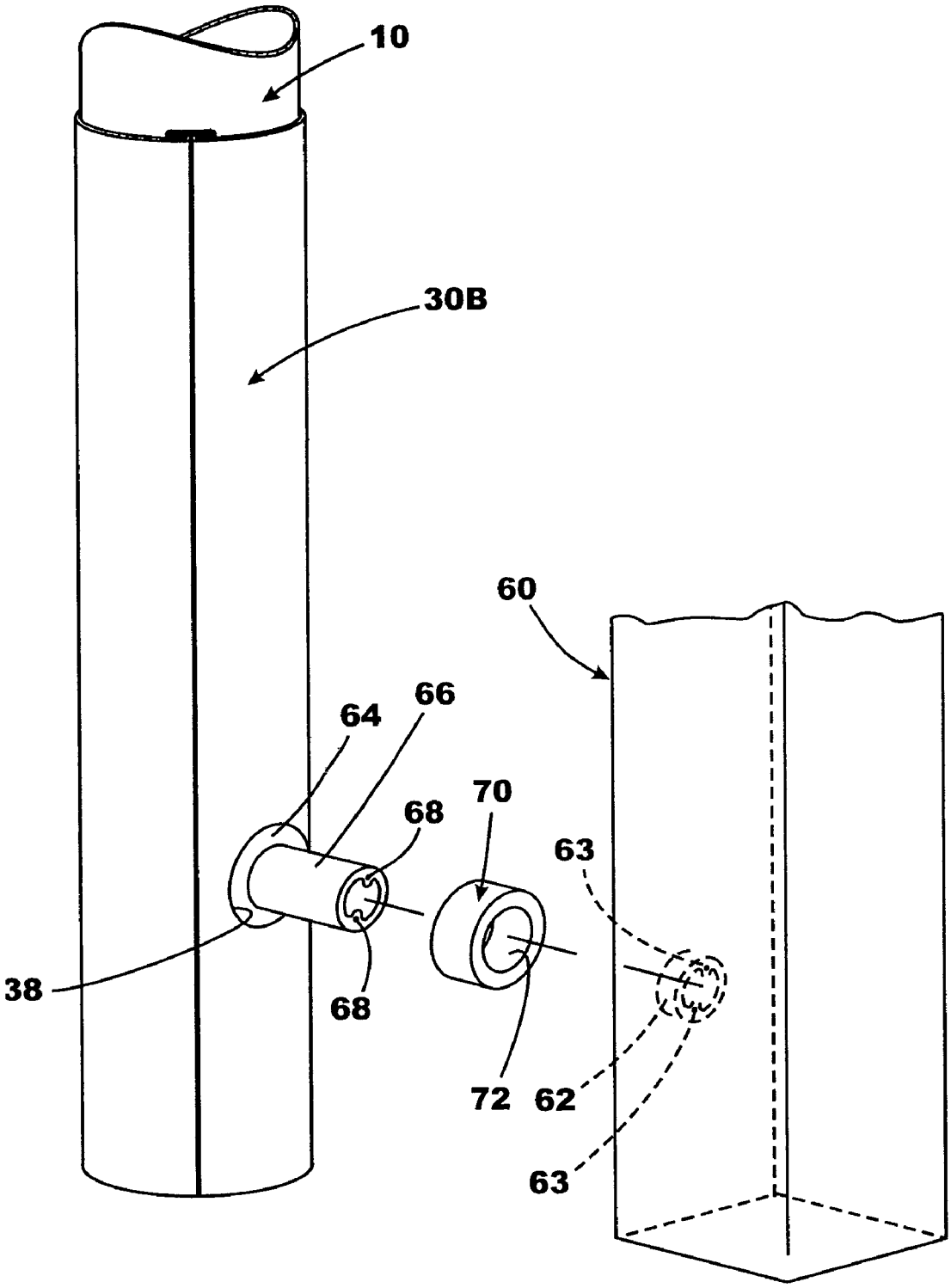
FIG. 8A is a partial sectional perspective view similar to FIG. 7 further showing an optional sealable connection assembly to an enclosure box that can be installed along the pole with the pole sleeve or cover 30B in place.
FIG. 8B is a partial perspective of an enclosure box that can be assembled to the combination of FIG. 8A.

FIGS. 7, 8A and B illustrate additionally that an optional sealing ring 70, having an opening 72 that could fit around the exterior of hub 66, could be utilized to seal off any gaps created by opening 38 and sleeve section 30B. Ballast box 60 could be mounted to hub 66 by bolting flanges 68 of hub 66 to flanges 63 of mounting portion 62 of ballast box 60. By inserting closed-cell silicone foam donut 70, or other sealing ring or structure, it would seal that combination off (particularly the hole 38 in sleeve 30B) from moisture. Preferably ring 70 would have a width that normally would exceed the distance between ballast box 60 and pole 10 such that when they are installed to one another ring 70 would compress and closely follow the contours of both ballast box 60 and the exterior pole 10 and exterior sleeve section 30B on pole 10.

Sheet 30 can be made of grade 510 or 550 Kydex® sheet, available from Kleerdex Company (Aiken, S.C., USA) or other commercial outlets. Kydex® is an extremely durable, acrylic/PVC alloy that offers excellent durability, resilience, chemical resistance, dimensional stability (e.g. low water absorption, relatively low coefficient of expansion), and flame-retardancy. It is also easy to machine and offers integral color, making it an ideal laminating material. It withstands impact, scratching, gouging and general abuse. It does not crack, break, chip, or snap and is available in a range of thicknesses (e.g. from 0.028" to 0.250"). However, it is bendable and can be post brake-formed or post-formed with or without wire heating to make seamless corners or fabricated into structural components using screws, rivets, commercially available adhesives, heat welding, and other common fasteners. It can be thermo formed. It is possible to saw, shear, rout, drill, sand, die-cut, mill, punch, machine, and file with conventional power tools. This vinyl material is UV resistant and has low thermal expansion. It can have some surfaced texturing. It can be embossed or have relief.

Kydex® can be purchased or created in a wide variety of colors. It comes in a variety of grades. It has clean ability and can take strong cleaners without fading, staining, or surface damage. It can include a weatherable cap.

Still further, as discussed above, the sleeve or cover could be used to cover only a portion of a pole or substantially all of the pole. Additionally, sections could be used to cover selected parts of base 20 and pole top 14. Additionally, some type of covering could be used to conform to the cross arms 14. Alternatively, the cross arms and/or base could be painted or otherwise colored to match or contrast with the color of the sleeves 30.

Colors can be selected to correlate to a desired concept. Some examples are (a) colors in the immediate environment around the pole, or (b) colors of some affiliation such as team, school, or sponsor.

Instead of a flat sheet of material, the material could be originally manufactured to have a cylindrical or truncated conical shape.

The cover or sleeve can be adapted to different pole sizes and shapes. For example, it could work with round, triangular, square or other cross-sectional pole shapes.

What is claimed is:

1. An apparatus comprising:

(a) a substantially tall hollow metal pole of one or more truncated conical sections thirty or more feet in total length, the pole having a wall with a thickness and an exterior surface;

(b) a covering layer of plastic sheet material having inner and outer sides, the inner side mounted in conforming relationship directly to the exterior surface of at least a substantial portion of the total length of the pole; and (c) the sheet material being a fraction of an inch thick;

(d) the sheet material having resistance to:

(i) water absorption;

(ii) substantial dimensional variation;

(iii) tearing;

(e) the sheet material being trapezoidal in a flat orientation, including rolled edges along opposite converging side edges, and having predesigned dimensions correlated with the pole such that opposite side edges are adjacent but not overlapping when the sheet material is placed around the pole, and the sheet material assumes a truncated conical shape directly covering the pole when the sheet material is wrapped around a portion of the pole;

(f) further comprising a fastener to secure the sheet in a wrapped position around a pole wherein the fastener comprises an elongated clip having a base with inwardly angled walls at opposite side edges of the base, in a normal position the inwardly angled walls defining an opening therebetween.

2. The apparatus of claim 1 wherein the pole is made of tubular material.

3. The apparatus of claim 2 wherein the tubular material is steel.

4. The apparatus of claim 1 wherein the pole is tapered.

5. The apparatus of claim 1 wherein the pole is slip-fittable to a base positioned in the ground or on a support.

6. The apparatus of claim 1 wherein the pole is elongated for elevating lighting fixtures on cross-arms.

7. The apparatus of claim 1 wherein the pole comprises a plurality of sections.

8. The apparatus of claim 7 wherein the sections slip-fit together.

9. The apparatus of claim 7 wherein the sheet material comprises an independent covering layer for each pole section.

10. The apparatus of claim 9 wherein a sheet material overlaps an adjacent sheet material.

11. The apparatus of claim 10 wherein the overlapping is succeeding lower parts over preceding upper parts of sheet material.

12. The apparatus of claim 1 wherein the sheet material is flexible.

13. The apparatus of claim 1 wherein the sheet material comprises vinyl.

14. The apparatus of claim 1 wherein the sheet material comprises a vinyl and acrylic alloy.

15. The apparatus of claim 1 wherein the fraction of an inch thick of the layer is approximately 0.040 inches thick.

16. The apparatus of claim 1 wherein the sheet material has top, bottom and opposite side edges.

17. The apparatus of claim 16 wherein opposite side edges are rolled into a U-shape, both on the same side of the sheet material.

18. The apparatus of claim 1 wherein the inwardly angled walls are deformable upon application of sufficient force to hold them inwardly and downwardly so that they exert clamping pressure.

19. The apparatus of claim 18 wherein the deformable walls are adapted to clamp the rolled under edges of sheet material upon deformation.

20. The apparatus of claim 1 further comprising a fastener adapted for passing through the sheet material and engagement with a pole or structure attached to a pole to prevent longitudinal movement of the sheet material.

21. The apparatus of claim 20 wherein the fastener comprises a screw.

22. The apparatus of claim 20 wherein the fastener comprises a bolt and the item adapted for attachment to a pole comprises a nut.

23. The apparatus of claim 1 further comprising an opening formed in the covering layer.

24. The apparatus of claim 23 wherein the opening formed in the covering layer is adapted to correspond to an opening or structure on the pole.

25. The apparatus of claim 23 further comprising a sealing member adapted to be positioned around the opening in the covering layer.

26. The apparatus of claim 1 further comprising a seal on top of the covering layer relative the hole.

27. The apparatus of claim 26 wherein the seal comprises a caulk-type material.

28. The apparatus of claim 1 wherein the covering layer substantially covers all of the pole.

29. The apparatus of claim 28 wherein the covering layer is colored.

30. The apparatus of claim 29 wherein the coloring is predesigned to match an environmental feature around a pole.

31. The apparatus of claim 29 wherein the coloring is predesigned to correspond to a recognized combination of colors indicating affiliation with a group or organization.

32. The apparatus of claim 1 wherein the covering layer is textured.

33. The apparatus of claim 1 wherein the covering layer is patterned.

34. An apparatus comprising:

(a) a substantially tall hollow metal pole of one or more tapered sections used to elevate at least one high intensity lighting fixture thirty or more feet to illuminate a wide area, the pole having a side wall with a thickness of a fraction of an inch and an exterior;

(b) a covering layer of material adapted to be positionable directly to at least a substantial part of the pole exterior;

(c) the covering layer comprising a flexible plastic, fraction of an inch thick sheet material adapted to be positioned in conforming relationship around the exterior of the pole, the layer being formable into a truncated cone substantially matching the taper of the pole;

(d) the width of the sheet material being predesigned such that opposite edges are adjacent but not when the sheet is wrapped in conforming relationship around the pole;

(e) further comprising a fastener to secure the sheet in a wrapped position around the pole wherein the fastener comprises an elongated clip having a base with inwardly angled walls at opposite side edges of the base, and in a normal position the inwardly angled walls defining an opening therebetween.

35. The apparatus of claim 34 wherein the pole is 30 foot or longer when assembled.

36. The apparatus of claim 34 further comprising a cross-arm for elevating lighting fixtures.

37. The apparatus of claim 34 wherein the inwardly angled walls are deformable upon application of sufficient force to hold them inwardly and downwardly so that they exert clamping pressure.

38. The apparatus of claim 37 wherein the deformable walls are adapted to clamp the rolled under edges of sheet material upon deformation.

39. The apparatus of claim 34 further comprising a fastener adapted for passing through the sheet material into engagement with the pole or structure attached to the pole to prevent longitudinal movement of the sheet material.

40. The apparatus of claim 39 wherein the fastener comprises a screw.

41. The apparatus of claim 34 wherein the covering layer is adapted to substantially cover all of a pole.

42. The apparatus of claim 41 wherein the covering layer is colored.

43. The apparatus of claim 42 wherein the coloring is predesigned to match an environmental feature around a pole.

44. The apparatus of claim 42 wherein the coloring is predesigned to correspond to a recognized combination of colors indicating affiliation with a group or organization.

45. The apparatus of claim 34 wherein the covering layer is textured.

46. The apparatus of claim 34 wherein the covering layer is patterned.

* * * * *